US011672058B2

(12) United States Patent
Chen

(10) Patent No.: US 11,672,058 B2
(45) Date of Patent: Jun. 6, 2023

(54) WHITE AND WARM WHITE LED SYNCHRONOUS INTELLIGENT FLEXIBLE LIGHT ASSEMBLY

(71) Applicant: JIANGSU LEDCO LIGHTING TECH CO., LTD., Yancheng (CN)

(72) Inventor: Genhai Chen, Yancheng (CN)

( * ) Notice: Subject to any disclaimer, the term of this patent is extended or adjusted under 35 U.S.C. 154(b) by 0 days.

(21) Appl. No.: 17/280,886

(22) PCT Filed: Jun. 1, 2020

(86) PCT No.: PCT/CN2020/093787
§ 371 (c)(1),
(2) Date: Mar. 27, 2021

(87) PCT Pub. No.: WO2021/082437
PCT Pub. Date: May 6, 2021

(65) Prior Publication Data

US 2022/0264715 A1 Aug. 18, 2022

(30) Foreign Application Priority Data

Oct. 30, 2019 (CN) ..... 201911044703.3

(51) Int. Cl.
*H05B 45/20* (2020.01)
*F21S 4/26* (2016.01)
(Continued)

(52) U.S. Cl.
CPC ..... *H05B 45/20* (2020.01); *F21S 4/26* (2016.01); *F21V 23/06* (2013.01); *F21V 25/10* (2013.01);
(Continued)

(58) Field of Classification Search
CPC ..... H05B 45/20; H05B 45/36; H05B 45/37; H05B 45/46; H05B 45/48; H05B 45/54;
(Continued)

(56) References Cited

U.S. PATENT DOCUMENTS 7,064,498 B2 * 6/2006 Dowling ..... H05B 47/155 362/139
10,299,321 B1 * 5/2019 Trask ..... H05B 45/20
2002/0195975 A1 * 12/2002 Schanberger ..... G09G 3/14 315/312
2005/0285547 A1 * 12/2005 Piepgras ..... H05B 45/20 315/294
(Continued)

FOREIGN PATENT DOCUMENTS

CN 108278566 A 7/2018
CN 108347804 A 7/2018
(Continued)

*Primary Examiner* — Haissa Philogene

(57) ABSTRACT

Disclosed is a white and warm white LED synchronous intelligent flexible light assembly, which includes an intelligent power supply and flexible light strings, the intelligent power supply includes a plug, a controller, a female terminal of a power wire, and the flexible light strings, formed by white and warm white LED diodes, are connected in parallel to a main wire, an IP44 plug is connected to a power supply, a filter and a filter circuit which is connected to an input of a MOSFET, and direct current of a DC transformer is output to a driving module and an IRF, a signal output by the IRF passes through a heat dissipation component and the driving module, outputs of the driving module and the DC transformer are connected to the input of the MOSFET, and a signal of the MOSFET is output to the light strings.

10 Claims, 4 Drawing Sheets

(51) Int. Cl.

| | |
|---|---|
| ***H05B 45/46*** | (2020.01) |
| ***H05B 47/19*** | (2020.01) |
| ***H05B 45/54*** | (2020.01) |
| ***F21V 23/06*** | (2006.01) |
| ***F21V 25/10*** | (2006.01) |
| *F21Y 115/10* | (2016.01) |

(52) U.S. Cl.
CPC ..... *H05B 45/46* (2020.01); *H05B 45/54* (2020.01); *H05B 47/19* (2020.01); *F21Y 2115/10* (2016.08)

(58) Field of Classification Search
CPC ..... H05B 47/19; F21V 23/06; F21V 25/10; F21S 4/26; F21Y 2115/10; Y02B 20/40
See application file for complete search history.

(56) References Cited

U.S. PATENT DOCUMENTS

| | | | | |
|---|---|---|---|---|
| 2008/0303445 | A1* | 12/2008 | Neuman | F21V 23/0471 315/76 |
| 2012/0323394 | A1* | 12/2012 | Gandhi | H04N 1/0097 700/297 |
| 2015/0102736 | A1 | 4/2015 | Yan | |
| 2017/0064796 | A1* | 3/2017 | Rumer | H05B 47/19 |

FOREIGN PATENT DOCUMENTS

| | | | |
|---|---|---|---|
| CN | 111093305 | A | 5/2020 |
| CN | 111132409 | A | 5/2020 |
| WO | 2019148524 | A1 | 8/2019 |
| WO | 2019148526 | A1 | 8/2019 |

* cited by examiner

WHITE AND WARM WHITE LED SYNCHRONOUS INTELLIGENT FLEXIBLE LIGHT ASSEMBLY

TECHNICAL FIELD

The present disclosure relates to the technical field of decorative lighting, and more particularly, to a white and warm white LED synchronous intelligent flexible light assembly.

BACKGROUND

White and warm white LED synchronous intelligent flexible light assembly is one of the main decorations for Christmas, and indispensable decorations for consumers, festivals, culture exchanges, cultural events and lighting projects for public area nightscape.

Technical Problem

Although the light string in the existing white and warm white LED synchronous intelligent flexible light assembly can achieve multiple change functions such as full color and single color, it cannot maintain color synchronization. Moreover, there is no synchronous remote control or electronic terminal control in different rooms, thereby making the operation inconvenient.

SUMMARY

The present disclosure aims to address the above technical problems to some extent through intelligent power control to achieve the synchronization effect of the intelligent flexible light, and thereby realizing the function switching of the synchronization effect of the intelligent flexible light by a remote control.

Given this, in order to address the above technical problems, the present disclosure provides a white and warm white LED synchronous intelligent flexible light assembly, which includes an intelligent power supply and flexible light strings, the intelligent power supply comprises a plug, a controller, a female terminal of a power wire that are connected in sequence by electric wires, and each of the flexible light strings is formed by white and warm white LED diodes connected in series, the flexible light strings are connected in parallel to a main wire of the white and warm white LED synchronous intelligent flexible light assembly, one end of the plug is connected to a power supply, the other end of the plug is connected to a filter for filtering out noise and separating signals and a filter circuit for attenuating high frequencies and passing low frequencies connected in sequence, outputs of the filter circuit are connected to an input of a MOSFET and a DC transformer respectively, the DC transformer outputs an direct current with an altered voltage to a driving module and an IRF, the IRF is connected to a program module, an synchronization command input by the program module for controlling the flexible light is processed by IRF, and an output signal is input to an input of the driving module through the heat dissipation component, outputs of the driving module and the DC transformer are both connected to the input of the MOSFET, and the command is transmitted to the flexible light strings.

In an embodiment, the IRF is further connected to a remote-control module or a WiFi & Bluetooth module.

In an embodiment, an anode of each white and warm white LED diode is connected to a cathode of an adjacent white and wain white LED diode, and a voltage drop resistor is arranged in the middle.

In an embodiment, the white and warm white LED diode has 2 pins, and the white and warm white LED is a two-pin light bead that uses control IC and LED chip packaging technology.

In an embodiment, the white and warm white LED has an outer diameter of 3 mm, 4 mm or 5 mm.

In an embodiment, the main wire of the flexible light is compression molded from plastic and copper wire through an extruder.

In an embodiment, the plug is a waterproof IP44 plug.

Beneficial Effects

The technical effects that can be achieved by this present disclosure are as follows: the present disclosure is a kind of white and warm white LED synchronous intelligent flexible light assembly, the light string in the white and warm white LED synchronous intelligent light assembly can achieve multiple change functions such as full-color color and single color, while maintaining color synchronization.

The flexible light of the present disclosure includes a control system. AC is converted to DC by a voltage converter, and is filtered through a circuit board. A programmer can program the function of the program chip by writing a program through the program module. The controller includes a WiFi & Bluetooth receiving and sending chip, a heat sink and other components. The output of the controller is reached through the circuit board, and then there is the female joint of the power supply. The remote control of the remote-control module or the terminal of the WiFi & Bluetooth module of the present disclosure automatically controls the full color change or on-off, thereby realizing remote control in multiple different floors and rooms, and being convenient to operate. The programmer can program according to the user's needs, so that the flexible light can display customized colors.

In which:

1 white and warm white LED diode bulb;
2 bracket;
3 wire;
4 wire anode;
5 wire cathode;
6 sheath;
7 female terminal;
8 controller;
9 voltage drop resistor;
10 IP44 plug;
11 tail plug;
12 remote control.

DETAILED DESCRIPTION

The present disclosure will be further described below with reference to the accompanying drawings and specific embodiments, so that those skilled in the art can better understand and implement the present disclosure. However, the embodiments provided are not intended to limit the present disclosure.

Figure 2:
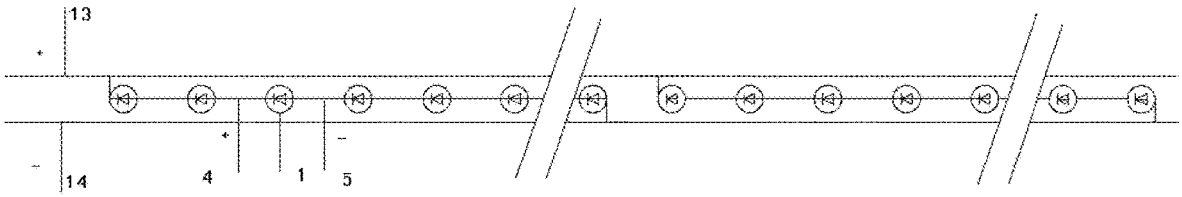
FIG. 2 is a schematic diagram of a circuit of a white and warm white LED synchronous intelligent flexible light assembly according to the present disclosure.
Figure 3:
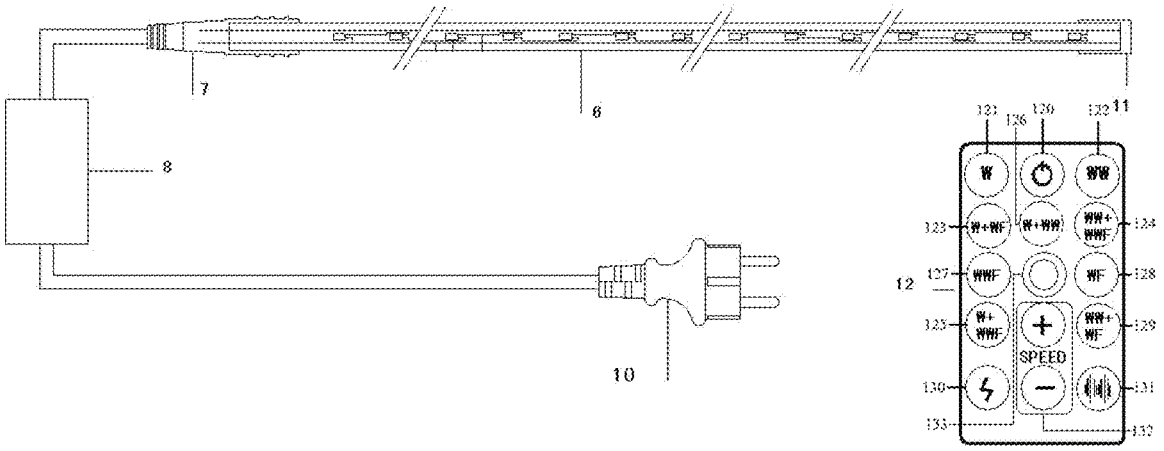
FIG. 3 is a structural schematic diagram of a white and warm white LED synchronous intelligent flexible light product according to the present disclosure.

As shown in FIGS. 2 and 3, according to a specific embodiment of the present disclosure, the voltage across the white and warm white LED diode bulb is 3.0-3.2V.

Figure 1:
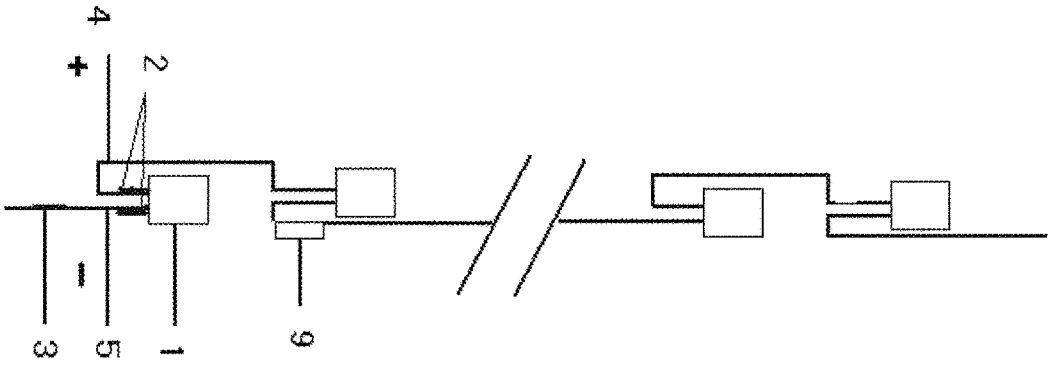
FIG. 1 is a schematic diagram of connected white and warm white LED diodes according to the present disclosure.

As shown in FIG. 1 and FIG. 2, the two brackets 2 at the bottom of the white and warm white LED diode bulb 1 are connected to the wire 3 by welding, the wire 3 is a copper wire, and the exposed wires respectively constitute the wire anode 4 of the white and warm white LED diode and the wire cathode 5 of the white and warm white LED diode, the anode of each white and warm white LED diode is connected to the cathode of the adjacent white and warm white LED diode, thus, the white and warm white LED diodes are connected into a string in series, and the voltage drop resistor 9 is arranged between the anode and cathode of the LED. The flexible light strings are connected in parallel to the anode 13 and the cathode 14 of the main wire of the white and warm white LED synchronous intelligent flexible light tube to form a closed circuit of the flexible light string.

According to a specific embodiment of the present disclosure, the main wire of the flexible light is compression molded from plastic and copper wire through an extruder.

As shown in FIG. 3, the intelligent power supply includes a IP44 plug 10, a controller 8, a female terminal 7 of a power wire that are connected in sequence by electric wires. A plurality of parallel-connected flexible light strings is provided with a sheath 6, and the tail of the sheath is provided with a tail plug 11. The female terminal 7 is connected with a plurality of parallel-connected flexible light strings to form the entire structure of the product.

According to a specific embodiment of the present disclosure.

Example 1

The effects of the white and warm white LED synchronous intelligent flexible light assembly are as follows:

1 Functions of Buttons:

120: Switch
121: Steady White
122: Steady Warm White
123: White+White Flashing
124: Warm White+Warm White Flashing
125: White+Warm White Flashing
126: Steady Light Warm White (the intermediate color between white and warm white is always on)
127: Warm White All Flashing
128: White All Flashing
129: Warm White+White Flashing
130: One On and One Off
131: Gradually lighter and gradually darker
132: Speed Control
133: Automatic Color Changing Function 1. Switch function:

The switch is configured to open and close the controller.

2. Steady function:

When the buttons Steady White, Steady Warm White and Steady Light Warm White are pressed, the white and warm white LED synchronous intelligent flexible light assembly presents the corresponding steady color.

3. Steady-plus-flashing function:

When the buttons White+White Flashing, Warm White+Warm White Flashing, White+Warm White Flashing and Warm White+White Flashing are pressed, the white and warm white LED synchronous Intelligent flexible light assembly presents the corresponding steady-plus-flashing color.

4. All-flashing function:

When the buttons Warm White All Flashing and White All Flashing are pressed, the white and warm white LED synchronous intelligent flexible light assembly presents the corresponding all-flashing color.

5. Gradually lighter and gradually darker function:

When the button Gradually lighter and gradually darker is pressed (white/warm white/light warm white), the process of gradually lighter and gradually darker takes 8 seconds, after each color is gradually brighter and darker twice, change to another color.

6. One on and one off function:

When the button One On and One Off is pressed (white/warm white/light warm white), it will flash for 15 seconds, and then change to another color.

7. Speed control function:

The speed control button + is pressed, the speed of the corresponding color presented by the white and warm white LED synchronous intelligent light string assembly is increased. When the speed control button – is pressed, the speed of the corresponding color presented by the white and warm white LED synchronous intelligent flexible light assembly is reduced.

8. Automatic color changing function:

When the button Automatic Color Changing Function is pressed, the white and warm white LED synchronized intelligent light string assembly presents the following functional effects.

(White/Warm White/Light Warm White) Steady color, change a color every 15 seconds.

(White+White Flashing/Warm White+Warm White Flashing/White+Warm White Flashing/Warm White+White Flashing), change a color every 15 seconds.

(White/Warm White/Light Warm White) Gradually lighter and gradually darker, the process of gradually lighter and gradually darker takes 8 seconds. After each color getting gradually lighter and gradually darker twice, change to another color.

(White/Warm White/Light Warm White) One On and One Off, after flashing for 15 seconds, change to another color.

(White Flashing/Warm White Flashing), the color changes every 15 seconds.

9. The above functions are divided into remote control and non-remote control. This function can be programmed and modified arbitrarily through computer programs. Under the same power line, the product maintains a synchronization effect no matter how long it operates after being powered on.

Example 2

The effects of the white and warm white LED synchronous intelligent flexible light assembly are as follows:

Automatic circulation function of the product:

Steady Warm White for 30 seconds, Warm White+Warm White Flashing for 30 seconds, Steady White for 30 seconds, White+White Flashing for 30 seconds, Warm White All Flashing for 30 seconds, White All Flashing for 30 seconds, Steady White+Warm White for 1020 seconds. Then the above functions will automatically cycle.

This function can be programmed and modified arbitrarily through computer programs. Under the same power line, the product maintains a synchronization effect no matter how long it operates after being powered on.

Figure 4:
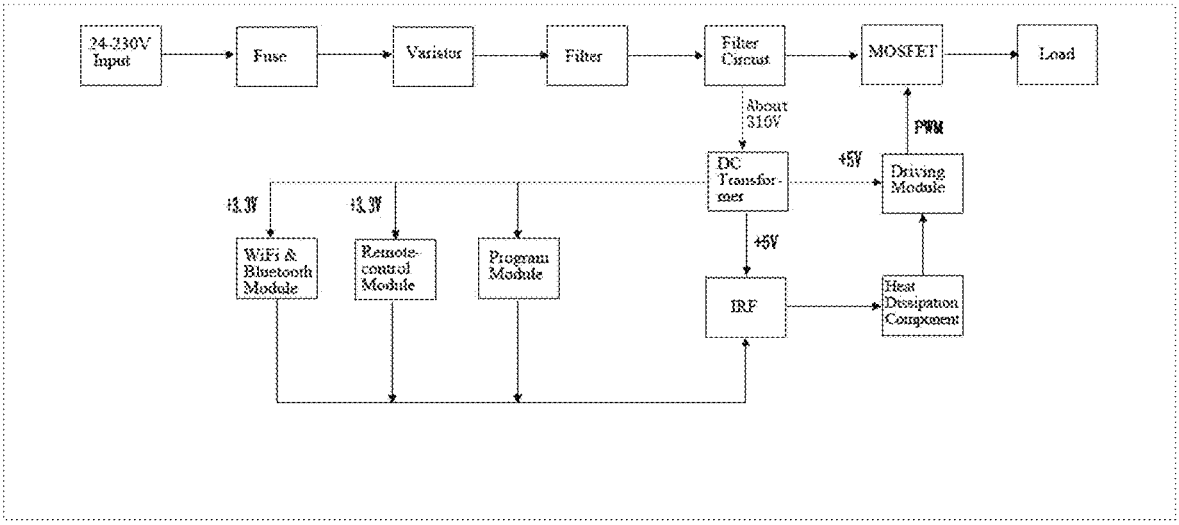
FIG. 4 is a circuit diagram of a control system for a white and warm white LED synchronous intelligent flexible light product according to the present disclosure.

As shown in FIG. 4, there is a circuit diagram of a control system for a white and warm white LED synchronous intelligent flexible light product according to the present disclosure. Connection method of the intelligent power supply: the IP44 plug is connected to the 24-230V power supply, and the voltage of 24-230V is input by the input of the control box. AC is converted to DC by the transformer of the power-on controller, and performing filtering through a circuit board. A programmer can program the function of the program chip by writing a program through the program module. The controller includes WiFi & Bluetooth receiving and sending chips, heat sinks and other components. The controller output is reached through the circuit board, and then there is the female joint of the power supply.

The specific connection method is: one end of the IP44 plug 10 is connected to the power supply, and the voltage of 24-230V is connected to the input of the controller. A second end of the plug is sequentially connected to, in sequence, a filter for filtering out noise and separating signals, and a filter circuit for passing the low frequencies and attenuating the high frequencies; outputs of the filter circuit are respectively connected to an input of the MOSFET and a DC transformer. The DC transformer outputs a direct current with an altered voltage to a driver and an IRF. The IRF is connected with a program module, a remote-control module and a WiFi & Bluetooth module. A signal from the IRE goes through a heat dissipation component and the driving module. Both of outputs of the driving module and the DC transformer are connected to an input of MOSFET, which is connected to a load at one end of the main wire, and the load is the flexible light string.

The fuse functions as below: when the circuit malfunctions or creates anomalies, the current keeps rising and it probably destroys some crucial devices or expensive devices in the circuit. Consequently, the circuit probably burns out or even a fire can be caused. If a fuse is properly arranged, it will melt when the current abnormally increases to a certain level within a certain time, and thereby interrupting the current and allowing safe operation of the circuit.

The fuse is connected to the varistor via a circuit board and the varistor is a protective device for voltage limitation. With the non-linear characteristic of the varistor, it can clamp the voltage to a certain value when overvoltage is applied thereon in order to protect the subsequent circuit.

The varistor is connected to the filter via the circuit board. The filter is a circuit or an operating and processing system that is capable of frequency selection, and plays a role in filtering noise and separating a variety of signals.

Via the circuit board, the filter is connected to the filter circuit which is configured for allowing passing a current with a certain frequency or attenuating a current with a certain frequency. There are four basic filtering circuits: high-pass filter (high frequencies are passed, low frequencies are attenuated), low-pass filter (low frequencies are passed, high frequencies are attenuated), band-pass filter (only frequencies in a frequency band are passed) and band-stop (trap) filter (only frequencies in a frequency band are attenuated).

The filter circuit is connected to the DC transformer via the circuit board. Specifically, the input direct current is converted to an alternating current through a self-oscillating circuit, and further converted to a direct current at an altered voltage transformed by the transformer for output, or further converted to a high-voltage direct current by a voltage doubling rectifier circuit for output.

The DC transformer is connected to the IRF via the circuit board. There are two main types of field-effect transistors. For metal-oxide semiconductor FET, MOS-FET for short, majority carriers participate in conducting, so it is also named as unipolar transistor, which belongs to a voltage-controlled semiconductor device and has advantages such as high input resistance, low noise and low power-consumption, wide dynamic range, great facility for integration, wide safe operating region without second breakdown.

The DC transformer is connected to a WiFi & Bluetooth module, a remote-control module and a program module via the circuit board. The WiFi & Bluetooth module is a PCBA integrating functions of WiFi and Bluetooth for short-range wireless communication, and it is composed of a data module and a vocal module. The WiFi & Bluetooth module is mainly used in the field of short-range data transmission and it is handy to be connected with a Bluetooth or WiFi device of a PC, a phone and a tablet computer to avoid tedious cable connecting and to take the place of serial link. The remote-control module is configured for controlling and function switching transmission while the program module refers to the component for editing or correcting the functional program file of the product.

Outputs of the WiFi & Bluetooth module, the remote-controlling module and the program module are connected to the IRF via the circuit board. Output of the IRF is connected to the heat dissipation component configured as a temperature protection assembly. Outputs of the DC transformer and the heat dissipation component are connected to an input of the driver which is configured for simulating the upper level module of the module to be test and is equivalent to the main program of the module to be test. An output of the driving module is connected to the MOSFET via the circuit board and an output of the MOSFET is connected to the load, wherein the MOSFET is a field-effect diode widely used in analog and digital circuits.

Figure 5:
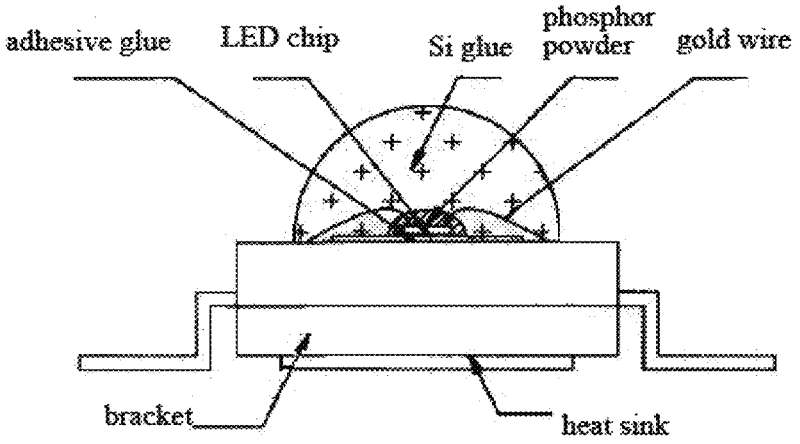
FIG. 5 is a schematic diagram of an internal structure of a white and warm white LED according to the present disclosure.

FIG. 5 shows the internal structure of a white and warm white LED diode. The LED is composed of chip, adhesive glue, SI glue, phosphor powder, gold wire, bracket and heat sink.

Figure 6:
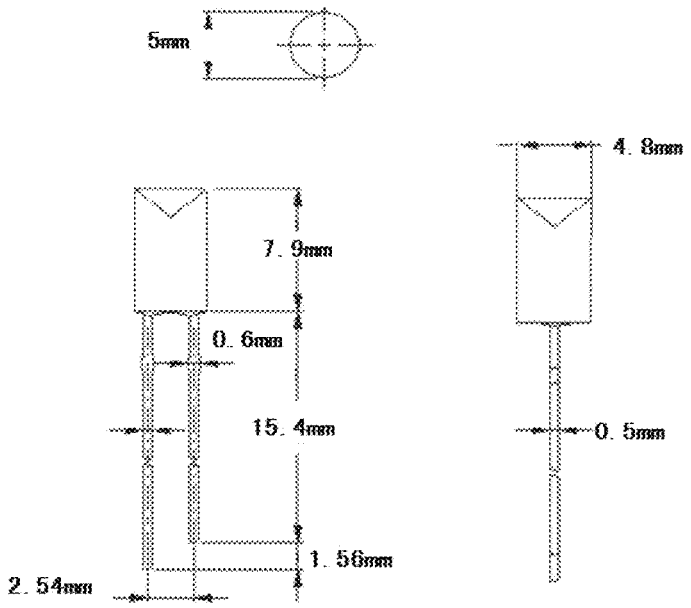
FIG. 6 is a schematic diagram of a size of a white and warm white LED according to the present disclosure.

FIG. 6 shows a size of a white warm white LED diode. An outer diameter of the bottom of the LED glue is 5 MM, an outer diameter of the top of the LED glue is 4.8 MM, the relevant dimensions of the bracket: width 0.6 MM, thickness 0.5 MM, length 15.4 MM, 17 MM, and the distance between the brackets is 2.54 MM.

Figure 7:
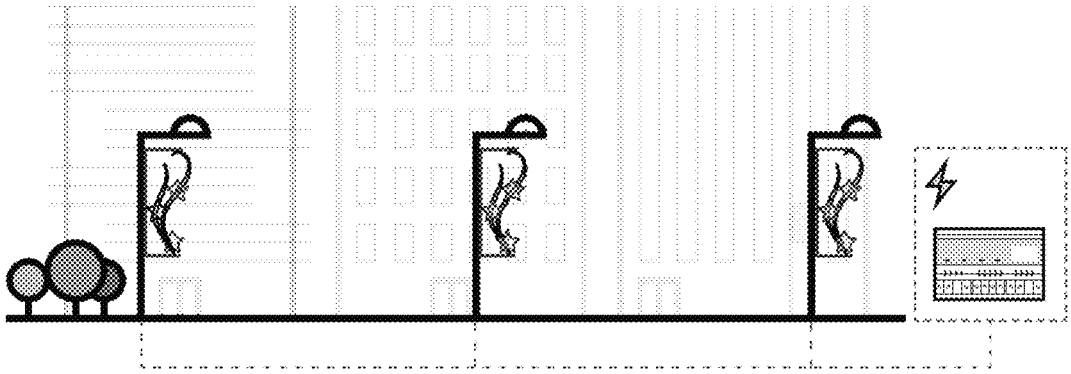
FIG. 7 is a schematic diagram of synchronization effect under a same line of a white and warm white LED synchronous intelligent flexible light assembly.

As shown in FIG. 7, the white and warm white LED synchronous intelligent light, under the same power line, the product maintains the synchronization effect regardless of how long the product is operating. The number of connected products is unlimited.

Figure 8:
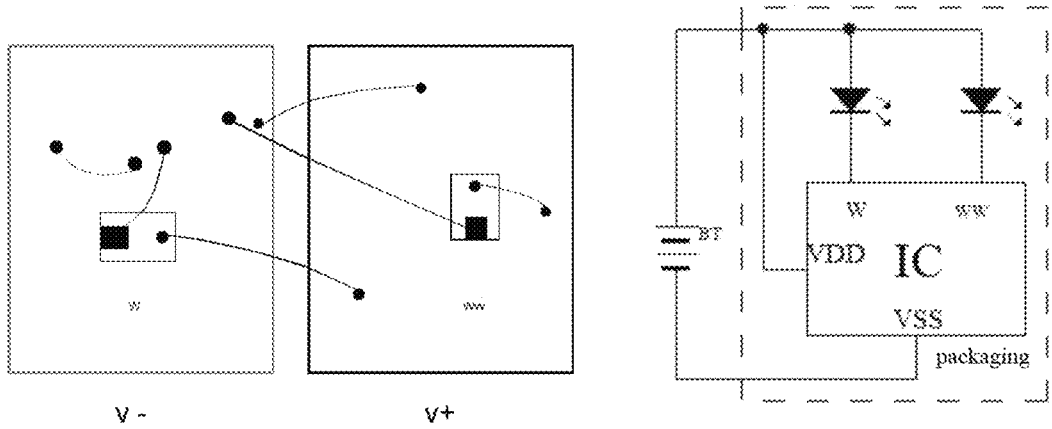
FIG. 8 is a schematic diagram of a white and warm white LED diode wiring package.

As shown in FIG. 8, the white and warm white LED is a two-pin light bead that uses control IC and LED chip packaging technology, two kinds of LED chips which are white LED chip and warm white LED chip being packaged inside the light bead, and the control IC is capable of controlling different flashing modes of the LED chips after receiving a command.

The above-mentioned embodiments are only preferred embodiments for fully explaining the present disclosure, and the protection scope of the present disclosure is not limited thereto. Equivalent substitutions or alterations made by those skilled in the art on the basis of the present disclosure are all within the protection scope of the present disclosure. The protection scope of the present disclosure is subject to the claims.

What is claimed is:

1. A white and warm white LED synchronous intelligent flexible light assembly, comprising:

an intelligent power supply comprising a plug; a controller including a) a filter for filtering out noise and separating signals and b) a filter circuit for attenuating high frequencies and passing low frequencies connected in sequence; and a female terminal of a power wire, which are connected in sequence by electric wires;

a plurality of flexible light strings, each of the plurality of flexible light strings including white and warm white LEDs, the white and warm white LEDs including diodes connected in series, the plurality of flexible light strings being connected in parallel to a main wire;

wherein outputs of the filter circuit are operatively connected to an input of a MOSFET and a DC transformer respectively, the DC transformer outputting a direct current with an altered voltage to a driving module and an input of an IRF during use and wherein outputs of the driving module and the DC transformer are both operatively connected to the input of the MOSFET, and the IRF is operatively connected to a program module, the program module including a color synchronization command program to control colors of the plurality of flexible light strings during use, and wherein a command signal is transmitted to the plurality of flexible light strings through an output of the MOSFET after being processed by the IRF.

2. The white and warm white LED synchronous intelligent flexible light assembly of claim 1, wherein under a same power line, the white and warm white LED synchronous intelligent flexible light assembly maintains a synchronization effect no matter how long it operates after being powered on.

3. The white and warm white LED synchronous intelligent flexible light assembly of claim 1, wherein, the white and warm white LED includes a synchronization function.

4. The white and warm white LED synchronous intelligent flexible light assembly of claim 1, wherein, the IRF is further connected to a remote-control module or a WiFi & Bluetooth module, and controls switching of synchronization commands through a wireless terminal.

5. The white and warm white LED synchronous intelligent flexible light assembly of claim 1, further comprising an anode and a cathode associated with each white and warm white LED diode, wherein each anode is connected to a cathode of an adjacent white and warm white LED diode, and a voltage drop resistor is configured and arranged in the middle of the anode and the adjacent cathode.

6. The white and warm white LED synchronous intelligent flexible light assembly of claim 1, wherein the white and warm white LEDs further comprise a two-pin light bead including control IC and LED chip packaging technology, two kinds of LED chips which are including a white LED chip and a warm white LED chip disposed inside the two-pin light bead, and wherein the control IC controls different flashing modes of the LED chips after receiving a command during use.

7. The white and warm white LED synchronous intelligent flexible light assembly of claim 1, wherein, the white and warm white LEDs have an outer diameter selected from a group consisting of 3 mm, 4 mm or 5 mm.

8. The white and warm white LED synchronous intelligent flexible light assembly of claim 1, wherein, the main wire of the plurality of flexible light strings is compression molded from plastic and copper wire through an extruder.

9. The white and warm white LED synchronous intelligent flexible light assembly of claim 1, wherein, the plug is a waterproof IP44 plug.

10. The white and warm white LED synchronous intelligent flexible light assembly of claim 1, further comprising a fuse and a varistor connected in series at an input of the filter.

* * * * *